United States Patent [19]

Slezak et al.

[11] Patent Number: 4,487,169

[45] Date of Patent: Dec. 11, 1984

[54] ELECTRONIC CONTROL UNIT FOR INTERNAL COMBUSTION ENGINES

[75] Inventors: Paul J. Slezak, Pierrefonds; Marcel J. P. E. Durand; Robert P. Dunlop, both of Montreal, all of Canada

[73] Assignee: KHD-Canada, Inc., Montreal, Canada

[21] Appl. No.: 418,028

[22] Filed: Sep. 14, 1982

[30] Foreign Application Priority Data

Apr. 3, 1982 [DE] Fed. Rep. of Germany ..... 3210504

[51] Int. Cl.[3] ..... F02N 17/00

[52] U.S. Cl. ..... 123/41.33; 123/41.65; 123/179 H

[58] Field of Search ..... 123/179 BG, 179 B, 179 H, 123/41.65, 41.11, 41.12, 41.49, 41.33

[56] References Cited

U.S. PATENT DOCUMENTS

| | | | |
|---|---|---|---|
| 4,088,109 | 5/1978 | Woodruff et al. | 123/179 B |
| 4,228,880 | 10/1980 | Gee | 123/41.12 |
| 4,348,990 | 9/1982 | Nolte et al. | 123/41.65 |
| 4,357,525 | 11/1982 | Jenne | 123/179 H |

FOREIGN PATENT DOCUMENTS

| | | | |
|---|---|---|---|
| 54-3630 | 1/1979 | Japan | 123/179 B |

*Primary Examiner*—William A. Cuchlinski, Jr.

*Attorney, Agent, or Firm*—Watson, Cole, Grindle & Watson

[57] ABSTRACT

A reciprocating piston internal combustion engine having a plurality of heads, a glow plug associated with each one of the pistons, a source of DC voltage, and a control for providing heating power to the glow plugs. The engine also has engine oil and transmission oil flowing therethrough, and a fan for cooling the oil. A first switch turns the fan on and off. There is included a central electronic control which includes thermistors for sensing a temperature related to the temperature of the engine and for providing a connection from the source of DC voltage to the glow plugs when the sensed temperature is below a predetermined value and for disconnecting the source when the sensed temperature is above the predetermined value. A duty cycle rate generator alternately connects and disconnects the source of DC voltage to the glow plugs above the preset value at a duty cycle rate which ranges from 0 to 100 percent and which depends on the voltage level of the source of DC voltage. The thermistors are disposed to measure the temperature of the first and eighth heads and the engine and transmission oil, and a second controller controls the first switch to turn the fan on and off depending on the temperature sensed by the temperature sensors. The control includes a second duty cycle rate generator, also ranging from 0 to 100 percent, but dependent on the magnitude of the most significant sensed temperature.

29 Claims, 3 Drawing Figures

ELECTRONIC CONTROL UNIT FOR INTERNAL COMBUSTION ENGINES

BACKGROUND OF THE INVENTION (a) Field of the Invention

The invention relates to a reciprocating piston internal combustion engine having a glow plug preheat system. The invention also relates to such an engine which has a fan for cooling the engine oil and transmission oil and the heads, and an automatic mechanism for controlling the operation of the fan controlled by temperature transducers at different points of the engine.

(b) Description of Prior Art

A generic reciprocating piston internal combustion engine (RPICE) of this kind, having a mechanism for measuring conditions, such as temperature, throughout the engine is known from U.S. Pat. No. 4,348,990. However, in this patent the idea of using the output of the measuring mechanism for driving an electro-magnetically operated valve is addressed only generally. As regards a practical design of such an installation, it is apparent to one skilled in the art that several important questions are not dealt with, and that inventive effort and considerations would be involved in the answering of these questions. In addition, there are other units of a RPICE which could advantageously automatically control or regulate, for example, the glow plug installation to improve cold starting and cold running characteristics of the RPICE.

Although German Patent PS No. 27 43 059 teaches a system for controlling the glow plug installation in an engine having one glow plug or glow pin reciprocating piston unit, this particular control unit covers only the heating phase of the glow plug installation and the power supply thereto after the desired glow temperature has been reached. Other important factors, essential to the satisfactory operation of a RPICE are not covered in this reference.

SUMMARY OF THE INVENTION

It is therefore an object of the invention to improve RPICEs by providing control mechanisms for glow plug preheat. It is also an object of the invention to provide, in a RPICE having a fan for cooling the engine oil and transmission oil and the heads, a mechanism for controlling the operation of the fan controlled by temperature transducers at different parts of the engine.

In accordance with the invention there is provided a RPICE having a plurality of heads, a glow plug associated with each one of the heads, a source of DC voltage and a control mechanism for providing heating power to the glow plugs from the source of DC voltage. The control mechanism includes a first mechanism for indicating a temperature related to the temperature of the engine and for providing a connection between the source of DC voltage to the glow plugs when the indicated temperature is below a predetermined value, and for disconnecting the source when the indicated temperature is above the predetermined value. A second mechanism alternately connects and disconnects the source of DC voltage to the glow plugs above the preset value at a duty cycle rate ranging from 0 to 100 percent. The duty cycle rate depends on the voltage level of the source of DC voltage.

In accordance with a further embodiment of the invention there is provided a RPICE having an engine oil and transmission oil carrying mechanism and a fan mechanism for cooling the oil and the heads as well as a switch mechanism for turning the fan mechanism on and off. A plurality of temperature sensors are disposed to sense temperature at various locations in the engine, and a control mechanism is provided for switching the switch mechanism when the control mechanism is activated. The output of all the temperature sensors are connected to an activating terminal of the control mechanism to activate the control mechanism at a duty cycle rate of 0 to 100 percent depending upon the magnitude of the most significant detected temperature.

The invention also relates to a RPICE having a central electronic control mechanism for controlling heating power to the glow plugs as above-defined, and for controlling the cooling fans as above-defined.

BRIEF DESCRIPTION OF THE DRAWINGS

Various other objects, features and attendant advantages of the present invention will be more fully appreciated as the same becomes better understood from the following detailed description when considered in connection with the accompanying drawings, in which like reference characters designate like or corresponding parts through the several views and wherein.

DETAILED DESCRIPTION OF THE PREFERRED EMBODIMENT

Figure 2:
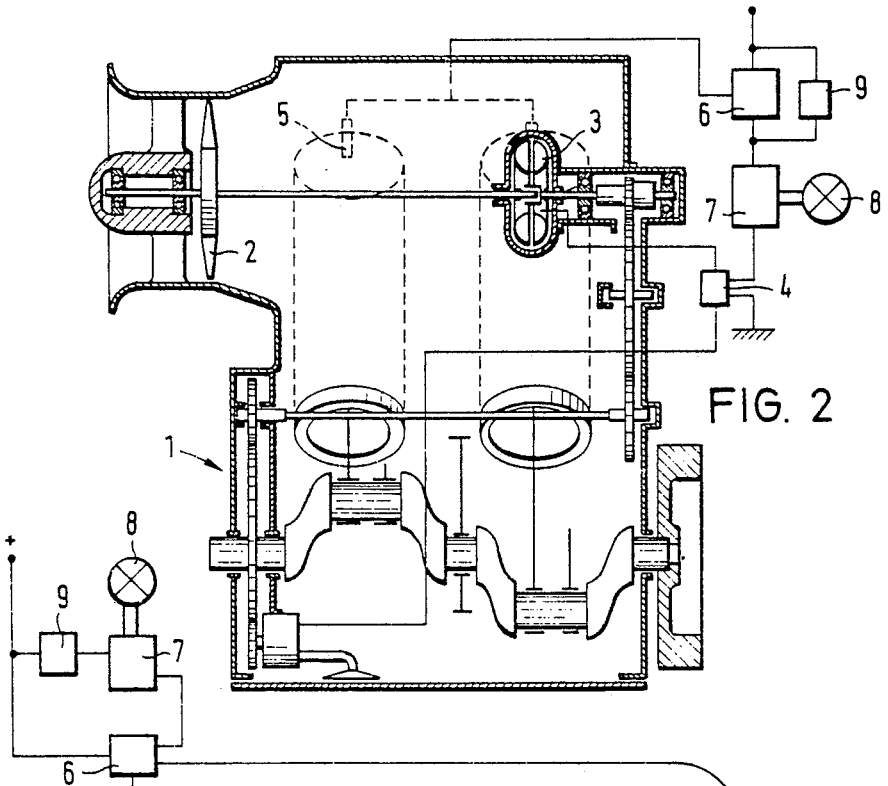
FIG. 2 is a partial longitudinal section through a RPICE according to FIG. 1.
Figure 1:
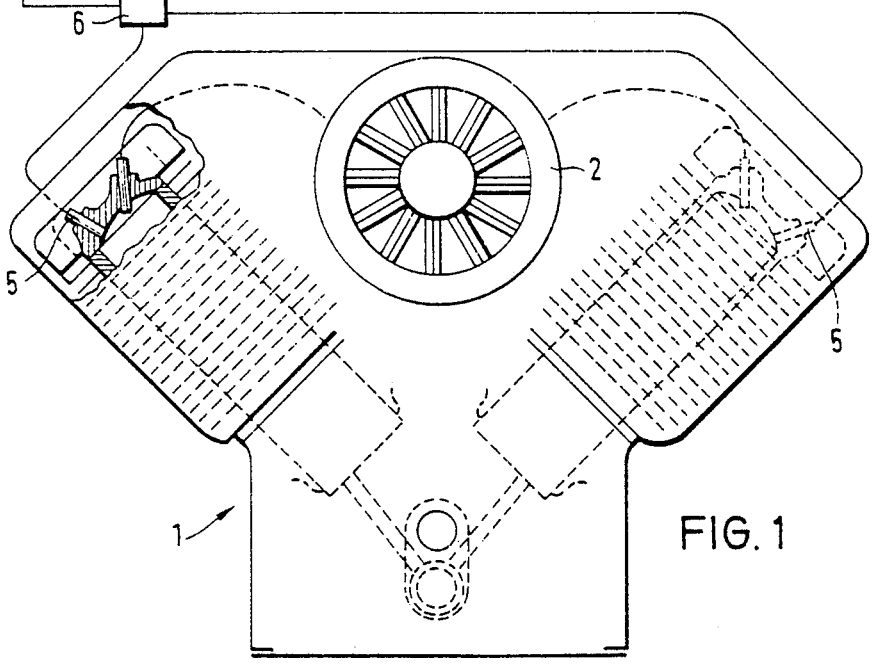
FIG. 1 is a front elevation of a reciprocating piston internal combustion engine (RPICE) having a central electronic control unit.

In FIGS. 1 and 2, the RPICE is indicated generally at 1. The illustrated RPICE operates on Diesel principles. The engine is supplied with cooling air by fan 2. In the illustrated embodiment, the fan is hydraulically driven. Incorporated into the fan drive is a hydrodynamic clutch 3 having a hydraulic supply controlled by an electro-magnetic distributor valve 4. In order to provide failsafe operation, the valve is of the normally open type, but is held closed to prevent the flow of hydraulic fluid to the fan drive when the engine is cold and does not require any cooling. An increased or reduced supply of hydraulic fluid alters the level of fluid in the valve, or reduces it to zero, to thereby vary the r.p.m. of the cooling fan. Although a hydraulically driven fan is illustrated in the drawings, it would be obvious to one skilled in the art that one can use an electrically driven fan instead.

The glow plug installation provides one glow plug pin 5 for each head, and each head comprises a separate reciprocating piston unit of the internal combustion engine. Associated with the glow plugs is a relay 6 controlled by the central electronic control unit 7. The control unit also controls the electro-magnetic distributor valve 4.

The central electronic control unit may be attached either to the RPICE or, if the RPICE is fitted to a vehicle, to any component thereof. Connected to the control unit is a pilot light 8 which may be located at a distance from the control unit. The pilot light must be located in the position where it can be seen by the driver and is therefore preferably located in the driver's compartment of the vehicle in which the RPICE is installed. The central electronic control unit is controlled by a stop-go-start switch 9 which is also arranged in a location easily accessible to the driver, for example, the driver's compartment.

Figure 3:
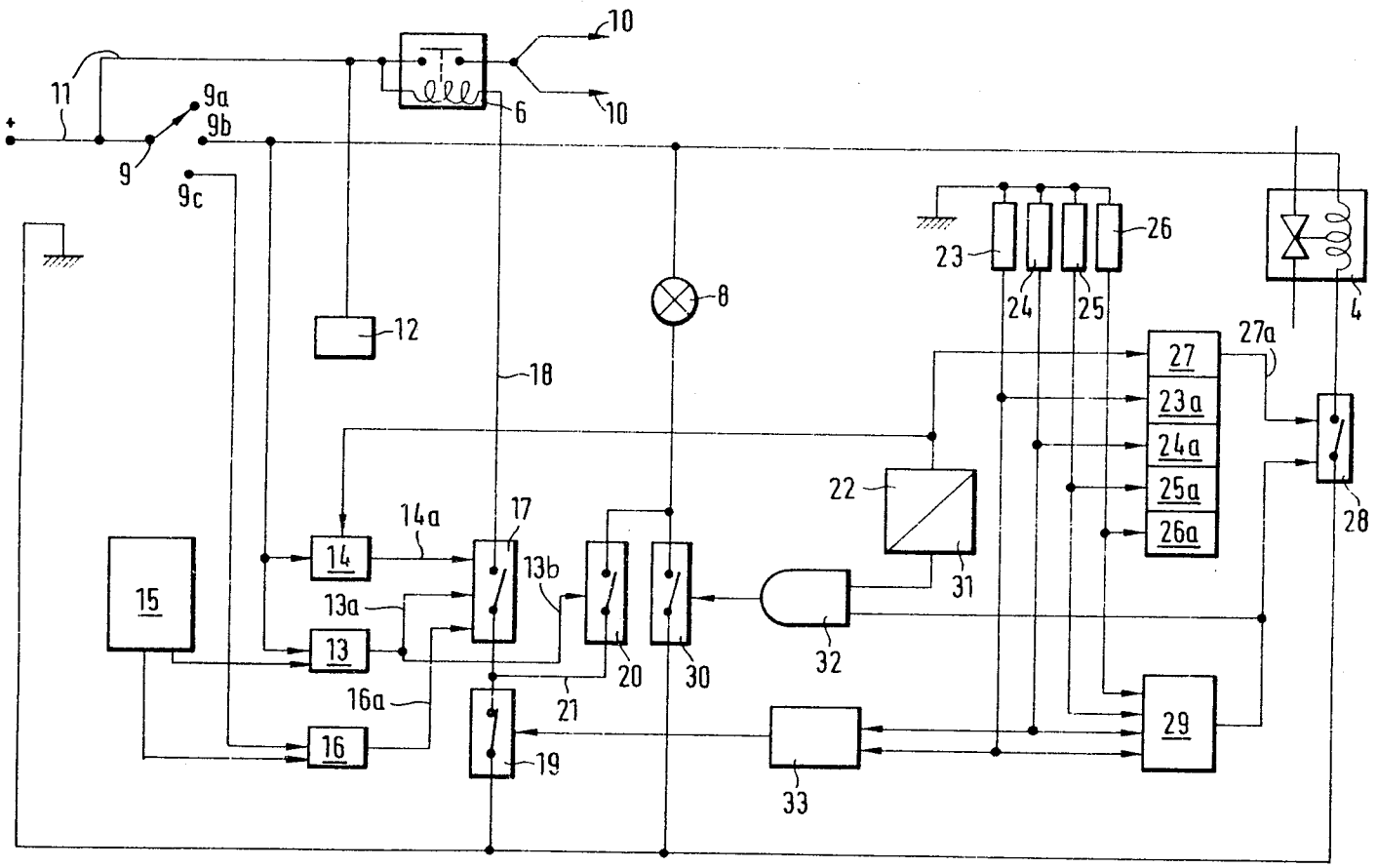
FIG. 3 is a block diagram of the central electronic control unit in accordance with the invention.

Turning now to FIG. 3, the central electronic control unit includes the switch 9 shown in greater detail in FIG. 3. As can be seen, switch 9 is a three-position switch with Stop (*9a*), Go (*9b*), and Start (*9c*) positions. Relay 6, also shown in greater detail, is shown to provide power to glow plug 5 through leads 10 when the relay is in its activated condition. Pilot light 8 and electro-magnetic distributor valve 4 are also shown in the circuit.

The supply line 11 is connected to a power supply including a source of DC voltage. Normally, this source of voltage is the vehicle battery. Also connected to the power supply via the line 11 is a peak voltage protection circuit 12 which protects the circuit elements against peak voltages produced by the lighting dynamo or by switching vehicle loads on and off. As can be seen, the switch 9 is also connected to the power supply.

When the switch is connected to position *9a*, the power supply is not connected to the circuit so that the circuit is inoperative. Connected to position *9b* are the following elements: voltage dependent % duty cycle set mechanism 14; glow plug preheat circuit 13. A reference voltage power supply 15, which provides reference voltages, is also connected to the position *9b*.

Connected to the activating terminal of the relay 6 is an electronic switch 17 and an electronic circuit breaker 19. As can be seen, when switch 17 and circuit breaker 19 are in their closed positions, there is a complete circuit path from the positive terminal of the power supply to ground through the coil of relay 6 so that relay 6 will be activated.

Position *9b* is also connected to one side of the pilot lamp 8, the other side of the pilot lamp being connected, through electronic switch 30, or through the combination of electronic switch 20 and electronic current breaker 19, to ground. Thus, when the switch is at *9b*, and switch 30 is closed, the pilot lamp will be turned on. When the switch is at *9b*, and switch 20 and circuit breaker 19 are closed, the pilot lamp will be turned on.

The above elements are involved in the glow plug preheat system as well as in a system for providing sufficient power to keep the glow plugs fully heated during operation of the vehicle. In order for preheat to take place, switch 19 must be closed as shown in FIG. 3. As will be seen below, this happens when engine temperature, as sensed by thermistors in 23 and 24, are below a predetermined value Glow plug preheat circuit 13 includes a mechanism for connecting constant power to the glow plugs until the glow plugs have reached a given temperature. It also includes a mechanism for connecting power to the glow plugs when the battery voltage is less than a predetermined reference amount. The mechanism for connecting power until the glow plugs have reached a given temperature includes an electronic circuit having a characteristic curve matching the characteristic curve of the glow plugs (e.g., an RC circuit). Thus, the circuit senses voltage related to the temperature of the glow plugs. Thermistor means are connected in circuit with the RC circuit to change the time constant of the RC circuit as a function of temperature, so that longer or shorter preheat times are provided. When switch 17 is closed, and circuit breaker 19 is in its normally closed position, relay 6 is activated and constant power is provided to the glow plugs. At a predetermined voltage of the RC circuit (i.e., a preset value of the sensed temperature given the starting temperature and the discharge rate of the RC circuit), the electronic circuit will permit electronic switch 17 to open so that relay 6 will become deactivated. When this happens the voltage dependent duty cycle set mechanism 14 will take over the supply of power to the glow plugs as will be described below.

The resistance of the thermistor in circuit with the RC circuit will, of course, be a function of outside temperature.

In addition to the RC circuit, the glow plug preheat circuit 13 includes a comparator for comparing the power supply source voltage with the reference voltage provided by reference power supply 15. If the battery or source voltage is less than the reference voltage, then the comparator will provide an output to keep electronic switch 17 closed so that the glow plugs will continue to get a constant power feed. The reference voltage for this purpose is normally of the order of $5\frac{1}{2}$ volts.

Assuming now that the battery voltage is greater than the reference voltage, and that the voltage of the RC circuit has acquired its predetermined level, the voltage dependent duty cycle set mechanism circuit 14 takes over the control of power to the glow plugs. In order to understand the operation of the duty cycle set mechanism 14, it should be pointed out that element 22 includes a duty cycle generator. Preferably, element 22 provides a periodic triangular output. In one embodiment, the period of the duty cycle generator of element 22 is two seconds.

The duty cycle set mechanism 14 includes a comparator, and one input electrode of the comparator is fed from the triangular wave generator 22. The other input is fed from the vehicle battery. When the two inputs coincide, an output is provided on lead 14*a* to close electronic switch 17. When electronic switch 17 is closed, power will once again be fed to the glow plugs through the leads 10. As will be apparent, the duty cycle of duty cycle set mechanism 14 will increase with decreasing magnitude of the battery voltage. Thus, power is provided to keep the glow plugs at temperature even after glow plug preheat circuit 13 is not operative, but not below the predetermined value of engine temperature.

When the switch 9 is initially turned to the Go position, glow plug preheat circuit 13 will provide an output on lead 13*b* to close electronic switch 20. Thus, pilot lamp 8 will be lit. This indicates to the operator to leave the switch 9 at the Go position. When glow plug preheat circuit 13 releases electronic switch 17, it will also release electronic switch 20 so that the pilot lamp 8 will be extinguished. The extinguishment of lamp 8 provides a signal to the operator to turn the switch to its Start position.

If the switch is, at this point, returned to position *9a* for a brief period of time, then, when the switch is returned to *9b*, the RC circuit glow plug preheat system 13 will be partially charged. Accordingly, the instant heating time at the second turning of the switch to *9b* will be determined by the lesser difference between the predetermined voltage and the charged RC voltage and will be a lesser time than an initial heating time of the cold engine.

When the switch is turned to *9c*, that is, to the Start position after pilot lamp 8 has been extinguished, glow plug preheat circuit 13 is taken out of the circuit. Crank system and glow plug heat system 16 is now connected into the circuit. The crank system and glow plug heat system 16 includes a voltage comparator to compare the battery source voltage to a different reference level supplied from reference power supply 15. The second reference level can be 13 volts when the battery source voltage is 28 volts. If the battery source voltage is below the second reference level, then the comparator in crank system and glow plug heat system 16 will provide an output, on line 16*a*, to close electronic switch 17 so that the glow plugs will be continuously fed. It is noted that the battery source voltage may drop during cranking of the engine, or may be low for other reasons. When the battery source voltage picks up, so that it is above 13 volts, then electronic switch 17 is released by the comparator in crank system and glow plug system 16 so that voltage is not fed, on a constant basis, to the glow plugs.

As above-mentioned, the present inventive system also includes a controller for turning on the cooling fan, the controller being initiated by temperatures at different parts of the engine. The system includes transducers 23, 24, 25 and 26. In the preferred embodiment, the transducers are thermistors, and thermistor 23 is located in a first cylinder head while thermistor 24 is located in an eighth cylinder head. Thermistor 25 measures the temperature of the engine oil, and thermistor 26 measures the temperature of the transmission oil. The output of the thermistors 23, 24, 25 and 26 are fed, respectively, to temperature range conditioners 23*a*, 24*a*, 25*a*, and 26*a*. The conditioners adjust the operating points of the electrical signal provided from the output of the thermistors.

The outputs of 23*a*, 24*a*, 25*a* and 26*a* are connected in parallel to a first input of a duty cycle set mechanism 27 which has a second input connected to the output of triangular wave generator 22. Duty cycle set mechanism 27 could include a comparator circuit having one input connected to triangular wave generator 22 and a second input connected to an ORed output of temperature range conditioners 23*a* to 26*a*. Duty cycle set mechanism 27 will provide an output on lead 27*a* at a duty cycle rate ranging from 0 to 100 percent. As the inputs 23*a* to 26*a* are fed in parallel to duty cycle set mechanism 27, the duty cycle rate will be a function of the most significant temperature measured by transducers 23 to 26. As will be apparent, the duty cycle rate will increase with increases in measured temperature.

When an output is provided on 27*a*, it will close electronic switch 28. This will open the valve 4, that is, this will release the closing mechanism on valve 4 so that it is opened so that hydraulic fluid can be fed to the fluid coupling 3 to cause the fan to operate and to thereby cool the engine and transmission oil.

The control system also includes a monitor for detecting a failure in any of the heat sensors 23 to 26. Such failure can include either an open circuit or a short circuit in the sensing system. The monitor 29 senses such a failure and, on the sensing of such a failure, provides a signal to close switch 28 so that hydraulic fluid is continuously provided to the cooling fan. In addition, with the exception of short circuit to ground failures of sensors 25 and 26, monitor 29 will provide an output to AND gate 32. The other terminal of AND gate 32 is connected to square wave generator 31. Thus, when open circuit failures are detected on sensors 23 to 26, or when short circuit failures are detected on sensors 23 and 24, AND gate 32 will provide an output equal to the output of square wave generator 31 so that switch 30 will be opened and closed on a periodic basis to provide a flashing signal on pilot lamp 8. This lets the operator know that he has a temperature sensor failure in the control unit.

The monitoring system also includes glow plug system shut-down mechanism 33. Mechanism 33 will close switch 19 when engine temperature, as measured in the first and eighth cylinder heads is below a predetermined value, say 50° C. When the temperature in the first and eighth cylinder heads is greater than the predetermined value, and should either transducer 23 or 24 fail at this time, glow plug system shut down mechanism 33 will provide an output to open circuit breaker 19 to disconnect the battery from the glow plugs.

It is noted that the solenoid of the valve 4 is connected to power only when the switch 9 is in its 9*b* GO position. This is, of course, the position that the switch will occupy during normal operation of the engine. It is particularly noteworthy that power is not supplied to the solenoid when the switch is in its 9*c* Start position. This is to avoid producing an additional load on the starter and is also to avoid the provision of unwanted cooling of a cold engine. Also, as the switch is in the Go position after the engine has started, the system ensures that the glow plugs are kept at operating temperatures while the engine is running. The satisfactory warming up phase eliminates white smoke associated with direct fuel injection internal combustion engines, and maintenance of the glow plug temperature gives improved exhaust gas values.

Obviously, numerous modifications and variations of the present invention are possible in light of the above teachings. It is therefore to be understood that within the scope of the appended claims, the invention may be practiced otherwise than as specifically described herein.

We claim:

1. An internal combustion engine having a plurality of reciprocating pistons disposed in separate cylinders therein, a plurality of glow plugs each having a variable temperature and a characteristic temperature curve representing an operational temperature range of said glow plugs wherein each of said glow plugs is operatively associated with one of said heads, a source of DC voltage having a first voltage level operatively associated with said glow plugs and electronic control means for regulating heating power to said glow plugs from said source of DC voltage, wherein said electronic control means comprises:

first means including a first mechanism for providing an electrical connection from said source to said glow plugs until said glow plugs have reached said operational temperature range, and for disconnecting said voltage from said source to said glow plugs after said glow plugs have reached said operational temperature range;

said first means further including a second mechanism for providing an electrical connection from said source to said glow plugs when the voltage level of said source is below a first predetermined reference level and the temperature of said glow plugs is below said operational temperature range; and second means for alternately connecting and disconnecting said source of D.C. voltage to said glow plugs after having reached said predetermined reference level, and after the temperature of said glow plugs is above said operational temperature range, at a duty cycle rate ranging from 0 to 100 percent, said duty cycle rate depending on said first voltage level of said source.

2. An engine as defined in claim 1, wherein said first mechanism of said first means comprises an electronic circuit having a characteristic curve matching said characteristic curve of said glow plugs, and a thermistor in circuit with said electronic circuit.

3. An engine as defined in claim 1, further comprising:

a source of reference voltage having a second voltage level at said predetermined reference level; and wherein said second mechanism of said first means comprises;

first comparator means for comparing said first voltage level of said source of DC voltage with said second voltage level of said source of reference voltage and for connecting said source of DC voltage to said glow plugs upon said first voltage level of said source of DC voltage being less than said second voltage level of said source of reference voltage.

4. An engine as defined in claim 1, wherein said second means comprises:

duty cycle generator means, and duty cycle setting means for setting said duty cycle rate and comprising a comparator having a first input thereof fed from said source of DC voltage and a second input thereof fed from said duty cycle generator means to set said duty cycle rate for alternately connecting and disconnecting said source of DC voltage to said glow plugs.

5. An engine as defined in claim 4 wherein said duty cycle generator means further comprises a triangular wave generator having a third voltage level such that said second means connects said source of DC voltage to said glow plugs upon said third voltage level of said triangular wave generator being equal to or greater than said first voltage level of said source of DC voltage.

6. The engine according to claim 4, wherein said duty cycle generator means provides a periodic triangular output.

7. An engine as defined in claim 1, further comprising:

a relay having an activation terminal for connecting said source of DC voltage to said glow plugs; and a switch connecting to ground and to said relay such that said activation terminal of said relay connects to ground via said switch wherein said second mechanism of said first means closes said switch upon said first voltage level of said source of DC voltage being less than said predetermined reference level, wherein said second mechanism of said first means opens said switch upon said first voltage level of said source of DC voltage being above said predetermined reference level, and wherein said second means alterately opens and closes said switch at said duty cycle rate upon said first voltage level of said source of DC voltage being above said predetermined reference level.

8. An engine as defined in claim 1, further comprising:

a three-position switch having stop, go and start positions operatively connected to said source of DC voltage;

a switch operatively associated with said first means;

a pilot lamp connected in series with said source of DC voltage and with said switch such that said pilot lamp is actuated by controlling said switch; and wherein said first means closes said switch upon operation of said three-position switch when the temperature of said glow plugs is below said operational temperature range.

9. The engine according to claim 1, wherein said electronic control means further comprises third means for providing an electrical connection from said source to said glow plugs when the voltage level of said source is below a second predetermined reference level, and for alternately connecting and disconnecting said voltage from said source to said glow plugs when the voltage level of said source is above said second reference level, said second reference level being higher than said first reference level.

10. An engine having engine oil and transmission oil and engine oil and transmission oil carrying means, fan means comprising a fan for cooling said oil and first electronic switch means for turning said fan on and off, said fan means further comprising hydraulic drive means and a solenoid-operated valve, said switch means controlling said valve for passing hydraulic fluid to said hydraulically driven fan means, wherein said engine further comprises:

control means comprising a duty cycle setting means for setting a duty cycle rate ranging from 0 to 100 percent;

a plurality of temperature sensors disposed to sense temperature at a plurality of locations in said engine and to provide outputs corresponding to said temperatures, at least two of said sensors being respectively connected to separate components of the engine, and the outputs of each of said sensors being connected in parallel to said duty cycle setting means;

said control means being provided for switching said first switch means when activated, said control means having an activating terminal such that said outputs of each of said temperature sensors is connected thereto so as to activate said control means at said duty cycle rate of 0 to 100 percent depending upon a magnitude of one of said sensed temperatures which is the most significant relative to all of said sensed temperatures.

11. An engine as defined in claim 10 wherein said temperature sensors further comprise thermistors.

12. An engine as defined in claim 11 having eight heads and further comprising:

a first thermistor for measuring temperature in a first head;

a second thermistor for measuring temperature in an eighth head;

a third thermistor for measuring temperature of said engine oil; and a fourth thermistor for measuring temperature of said transmission oil, wherein said first, second, third and fourth thermistors are operatively associated with said duty cycle setting means;

said fan providing cooling air for said heads.

13. An engine as defined in claim 10, wherein said control means further comprises a duty cycle generator including a triangular wave generator, said duty cycle setting means including first and second input elements such that said outputs of said sensors are fed to said first input of said duty cycle setting means and said output of said duty cycle generator is fed to said second input to said duty cycle setting means.

14. The engine according to claim 10, further comprising a pilot lamp and an electronic switch connected in series with said first switch means and with a source of D.C. voltage, and means for sensing a failure in any of said temperature sensors, said sensing means closing said switch means, upon the sensing of such failure, to set said fan in an operative mode, and means operative by said sensing means, upon the sensing of such failure, for effecting a flashing light signal presented by said pilot lamp.

15. An engine as defined in claim 14, wherein said means operative by said sensing means comprises:

an AND gate having first and second input terminals operatively associated with said control means;

a square wave generator for producing an output operatively associated with said control means such that said output of said square wave generator is fed to said first input terminal of said AND gate and such that said output of said sensing means is fed to said second input terminal of said AND gate.

16. An internal combustion engine having a plurality of reciprocating pistons disposed in cylinders therein, a plurality of glow plugs each having a variable temperature and a characteristic temperature curve representing an operational temperature range of said glow plugs wherein each of said glow plugs is operatively associated with one of said heads, a source of DC voltage having a first voltage level operatively associated with said glow plugs, first control means for regulating heating power to said glow plugs from said source of DC voltage, engine oil and transmission oil and carrying means therefor, fan means comprising a fan for cooling said oil and said heads, first electronic switch means for actuating said fan means and central electronic control means comprising:

first means for sensing a temperature related to the temperature of said glow plugs and for providing an electrical connection from said source of DC voltage to said glow plugs upon said sensed temperature being below a predetermined value, and for disconnecting said source of DC voltage upon said sensed temperature being above said predetermined value;

second means for alternately connecting and disconnecting said source of DC voltage to said glow plugs above said predetermined value at a first duty cycle rate ranging from 0 to 100 percent depending on said first voltage level of said source of DC voltage;

a plurality of temperature sensors disposed to sense temperature at a plurality of locations in said engine and to provide corresponding outputs corresponding to said temperatures, at least two of said sensors being respectively connected to separate components of the engine; and second control means for switching said first switch means when said second control means is activated, said second control means further comprising an activating terminal wherein said outputs of each of said temperature sensors are connected in parallel to said activating terminal of said second control means so as to activate said second control means at a second duty cycle rate of 0 to 100 percent depending upon a magnitude of one of said sensed temperatures which is the most significant relative to all of said sensed temperatures.

17. An engine as defined in claim 16 wherein said first means comprises an electronic circuit having a characteristic curve matching said characteristic temperature curves of said glow plugs, and a first thermistor in circuit with said electronic circuit.

18. An engine as defined in claim 17 further comprising:

a source of reference voltage having a second voltage level; and first comparator means operatively associated with said first means and provided for comparing said first voltage level of said source of DC voltage with said second voltage level of said source of reference voltage and for constantly connecting said source of DC voltage to said glow plugs upon said first voltage level of said source of DC voltage being less than said second voltage level of said source of reference voltage.

19. An engine as defined in claim 18, wherein said second means comprises:

duty cycle generator means for providing an output, and first duty cycle setting means for setting said first duty cycle rate and comprising a first comparator having a first input thereof fed from said source of DC voltage and a second input thereof fed from said duty cycle generator means so as to set said first duty cycle rate for alternately connecting and disconnecting said source of DC voltage to said glow plugs.

20. An engine as defined in claim 19 further comprising:

a relay having an activation terminal and operatively associated with said source of DC voltage wherein said source of DC voltage is connected to said glow plugs via said relay; and second switch means connecting said activation terminal of said relay to ground such that said first means closes said second switch means upon said sensed temperature being below said predetermined value, such that said first means opens said second switch means upon said sensed temperature being above said predetermined value, and such that said second means alternately opens and closes said second switch means at said first duty cycle rate upon said sensed temperature being below said predetermined value, and upon said first voltage level of said source of DC voltage being above said second voltage level of said source of reference voltage.

21. An engine as defined in claim 20 further comprising:

a three-position switch having off, on and start positions;

third switch means operatively associated with said first means;

a pilot lamp connected in series with said source of DC voltage and said third switch means, such that said pilot lamp is actuated by controlling said third switch means; and said first means further comprising means for closing said third switch means upon said sensed temperature being below said predetermined value.

22. An engine as defined in claim 21 further comprising:

third means operatively associated with said first control means and activated upon said three-position switch being placed in said start position;

said source of reference voltage further comprising a third reference voltage level; and said third means further comprising second comparator means for comparing said first voltage level of said source of DC voltage to said third voltage level of said source of reference voltage to maintain said second switch means closed upon said first voltage level of said source of reference voltage being below said third reference voltage level of said source of reference voltage, and to alternately open and close said second switch means as a function of said first voltage level of said source of DC voltage upon said first voltage level of said source of DC voltage being above said third voltage level of said source of reference voltage.

23. An engine as defined in claim 22 wherein said duty cycle generator means further comprises a triangular wave generator having a period of two seconds.

24. An engine as defined in claim 23 wherein said plurality of temperature sensors comprises a plurality of thermistors.

25. An engine as defined in claim 24 having eight heads, and further comprising:

a second thermistor for measuring temperature in a first head;

a third thermistor for measuring temperature in an eighth head;

a fourth thermistor for measuring temperature of said engine oil; and a fifth thermistor for measuring temperature of said transmission oil, wherein said second, third, fourth and fifth thermistors are operatively associated with and provide outputs for said central electronic control means.

26. An engine as defined in claim 25 wherein said central electronic control means further comprises second means for setting a second duty cycle rate and having first and second inputs wherein said outputs of said second, third, fourth and fifth thermistors are fed to said first input of said second means for setting a second duty cycle rate and wherein said output of said duty cycle generator means is fed to said second input of said second means for setting a duty cycle rate.

27. An engine as defined in claim 26 further comprising means for sensing a failure in each of said second, third, fourth and fifth thermistors and for providing a corresponding output and being connected to said first switch means such that upon sensing a failure said means for sensing a failure sets said first switch means to place said fan in an operative mode.

28. An engine as defined in claim 27 and further comprising:

an AND gate for providing an output to said third switch means and having first and second input terminals; and a square wave generator for providing an output to said first input terminal of said AND gate wherein said output of said means for sensing a failure is fed to said second input terminal of said AND gate such that upon sensing a failure, said means for sensing a failure initiates a flashing light signal on said pilot light.

29. An engine as defined in claim 28 wherein said fan means further comprises hydraulic drive means and an electro-magnetic distributor valve, and wherein said first switch means controls said electromagnetic distributor valve for passing hydraulic fluid to said hydraulically driven fan means.

* * * * *